US009604341B2

(12) United States Patent
Truong et al.

(10) Patent No.: US 9,604,341 B2
(45) Date of Patent: Mar. 28, 2017

(54) DRIVE SYSTEM FOR ORBITAL GRINDER

(71) Applicant: Innovatech Products and Equipment Co., Everett, WA (US)

(72) Inventors: Phil Truong, Everett, WA (US); Roger Wiggins, Kenmore, WA (US); Shawn Wiggins, Monroe, WA (US)

(73) Assignee: Innovatech Products and Equipment Co., Everett, WA (US)

( * ) Notice: Subject to any disclaimer, the term of this patent is extended or adjusted under 35 U.S.C. 154(b) by 310 days.

(21) Appl. No.: 14/450,880

(22) Filed: Aug. 4, 2014

(65) Prior Publication Data

US 2016/0031061 A1 Feb. 4, 2016

(51) Int. Cl.

| | |
|---|---|
| ***B24B 47/12*** | (2006.01) |
| ***A47L 11/14*** | (2006.01) |
| ***B24B 23/03*** | (2006.01) |
| ***B24B 7/18*** | (2006.01) |
| ***B24B 23/02*** | (2006.01) |
| ***A47L 11/40*** | (2006.01) |

(52) U.S. Cl.

CPC ..... *B24B 47/12* (2013.01); *A47L 11/14* (2013.01); *A47L 11/4069* (2013.01); *B24B 7/186* (2013.01); *B24B 23/024* (2013.01); *B24B 23/03* (2013.01)

(58) Field of Classification Search

CPC ..... A47L 11/14; A47L 11/4069; B24B 23/02; B24B 23/024; B24B 23/03; B24B 7/18; B24B 7/186; B24B 47/12; B24B 41/047

USPC ..... 451/353

See application file for complete search history.

(56) References Cited

U.S. PATENT DOCUMENTS

| | | | | |
|---|---|---|---|---|
| 835,631 | A | 11/1906 | Mooney et al. | |
| 862,747 | A | 8/1907 | Miller | |
| 1,928,390 | A | 9/1933 | Myers | |
| 4,097,950 | A | 7/1978 | Satterfield | |
| 5,070,656 | A | 12/1991 | Brogden | |
| 5,637,032 | A | 6/1997 | Thysell et al. | |
| 5,863,241 | A * | 1/1999 | Rottschy | B24B 41/047 451/271 |
| 6,752,707 | B1 * | 6/2004 | Palushi | B24B 41/047 451/350 |
| 7,137,875 | B2 | 11/2006 | Jeansson | |
| 7,140,957 | B2 | 11/2006 | Thysell et al. | |
| 7,241,210 | B2 * | 7/2007 | Van Vliet | A47L 11/16 451/353 |

(Continued)

OTHER PUBLICATIONS

Innovatech User Manual, "Predator 2400," The Surface Preparation Specialists, Washington Sales Office, 832 80th Street SW, Everett, WA 98203, updated Aug. 2006.

*Primary Examiner* — Eileen Morgan

(74) *Attorney, Agent, or Firm* — Luedeka Neely Group, P.C.

(57) ABSTRACT

A drive unit for imparting rotation to a drum assembly of a floor grinder. The drive unit includes a rotatable pulley positioned adjacent to and in contact with a rotatable drive surface of a driven pulley of the drum assembly and a drive surface of the drum assembly. The rotatable drive surface of the driven pulley is configured to impart rotation to the rotatable drive pulley during rotation of the rotatable drive surface, and the rotatable drive pulley is configured to impart rotation thereof to the drum assembly.

3 Claims, 11 Drawing Sheets

(56) References Cited

U.S. PATENT DOCUMENTS

| | | | | |
|---|---|---|---|---|
| 7,261,623 | B1 * | 8/2007 | Palushi | B24B 7/186 451/350 |
| 7,326,106 | B1 * | 2/2008 | Rogers | B24B 7/186 15/49.1 |
| 7,658,667 | B2 | 2/2010 | Thysell et al. | |
| 7,993,184 | B2 | 8/2011 | Thysell et al. | |
| 8,092,282 | B2 * | 1/2012 | Bergstrand | B24B 7/186 451/259 |
| 8,342,914 | B2 | 1/2013 | Thysell | |
| 8,684,796 | B2 * | 4/2014 | McCutchen | B24B 7/186 451/350 |
| 2007/0184762 | A1 * | 8/2007 | Dummermuth-Furter | B24B 41/047 451/353 |
| 2010/0015896 | A1 * | 1/2010 | Bergstrand | B24B 7/186 451/259 |
| 2013/0084782 | A1 * | 4/2013 | McCutchen | B24B 7/186 451/28 |

* cited by examiner

DRIVE SYSTEM FOR ORBITAL GRINDER

FIELD

This present disclosure relates to orbital surface treatment equipment. More particularly, the disclosure relates to a drive system for equipment for polishing, grinding, or otherwise treating stone and masonry flooring surfaces.

BACKGROUND

Orbital floor grinders typically include an electric motor having an output shaft that extends through a drum assembly. The output shaft drives a belt that drives a plurality of treatment disks that contact the flooring surface. To improve handling of the machine and the treatment effects to the flooring, the orbital machine is typically configured to counter-rotate the drum housing relative to the direction of rotation of at least some of the treatment disks.

The present disclosure relates to an improved configuration for rotating the drum assembly that avoids the need for a separate traveling belt for rotating the drum assembly.

SUMMARY

The disclosure advantageously provides a floor grinder having a rotatable drum assembly.

In one aspect, the grinder includes a drum assembly having a driven pulley having a rotatable drive surface; a drive surface operatively associated with the drum assembly; and a drive unit for imparting rotation to the drum assembly.

The drive unit includes a rotatable pulley positioned adjacent to and in contact with the rotatable drive surface of the driven pulley of the drum assembly and the drive surface of the drum assembly. The rotatable drive surface of the driven pulley is configured to impart rotation to the rotatable drive pulley during rotation of the rotatable drive surface. The rotatable drive pulley is configured to impart rotation thereof to the drum assembly.

In another embodiment, the grinder includes a motor having a rotatable output shaft and a drum assembly. The drum assembly includes a drive pulley connected to the output shaft of the motor, a driven pulley, and a traveling belt travelable around the output shaft and the driven pulley and configured to have a direction of travel imparted to it by the output shaft during operation of the motor to rotate the output shaft. The driven pulley has a shaft extending above an exterior portion of the drum assembly to provide a rotatable drive surface.

The grinder further includes a motor mount connected to the motor; a bearing between the motor mount and the drum assembly to enable the drum assembly to rotate relative to the motor; a drive surface operatively associated with the drum assembly; and a drive unit for imparting rotation to the drum assembly. The drive unit includes a rotatable pulley positioned adjacent to and in contact with the rotatable drive surface of the driven pulley of the drum assembly and the drive surface of the drum assembly. The rotatable drive surface of the driven pulley is configured to impart rotation to the rotatable drive pulley during rotation of the rotatable drive surface, and the rotatable drive pulley is configured to impart rotation thereof to the drum assembly.

During operation of the motor, the output shaft rotates to travel the traveling belt and impart rotation to the driven pulley and the drive surface. The drive surface imparts rotation to the drive pulley, which imparts rotation to the drum assembly.

In yet another embodiment, the grinder includes a motor having a rotatable output shaft and a drum assembly. The drum assembly includes a drive pulley connected to the output shaft of the motor, at least two driven pulleys, and a traveling belt travelable around the output shaft and the two driven pulleys and configured to have a direction of travel imparted to it by the output shaft during operation of the motor to rotate the output shaft. The traveling belt is arranged to impart travel to one of the driven pulleys in a direction corresponding to the direction of travel imparted to the traveling belt and to impart travel to the other one of the driven pulleys in a direction of travel opposite to the direction of travel imparted to the traveling belt, one of the driven pulleys having a shaft extending above an exterior portion of the drum assembly to provide a rotatable drive surface.

The grinder also includes a motor mount connected to the motor; a bearing between the motor mount and the drum assembly to enable the drum assembly to rotate relative to the motor; a drive surface operatively associated with the drum assembly; and a drive unit for imparting rotation to the drum assembly. The drive unit includes a rotatable pulley positioned adjacent to and in contact with the rotatable drive surface of the driven pulley of the drum assembly and the drive surface of the drum assembly. The rotatable drive surface of the driven pulley is configured to impart rotation to the rotatable drive pulley during rotation of the rotatable drive surface, and the rotatable drive pulley is configured to impart rotation thereof to the drum assembly.

During operation of the motor, the output shaft rotates to travel the traveling belt and impart rotation to the two driven pulleys and the drive surface. The drive surface imparts rotation to the drive pulley, which imparts rotation to the drum assembly.

BRIEF DESCRIPTION OF THE DRAWINGS

Further advantages of the disclosure are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
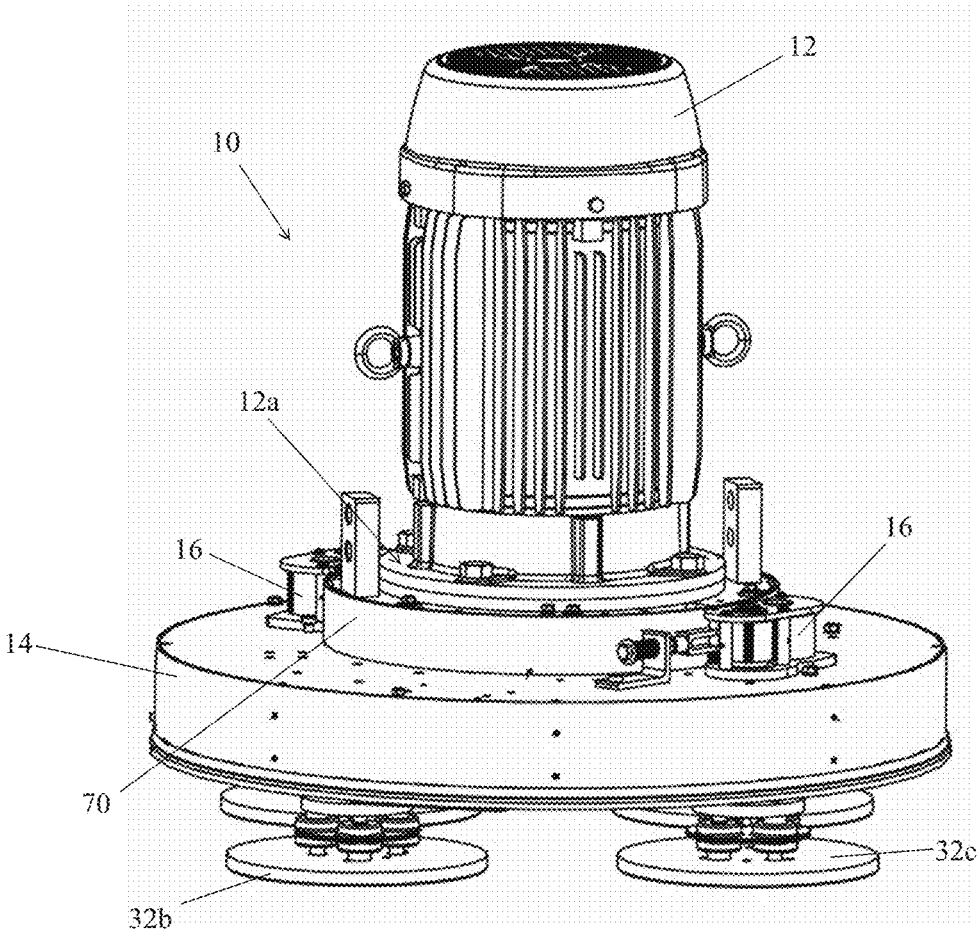
FIGS. 1 and 2 show a grinder according to the disclosure.
Figure 2:
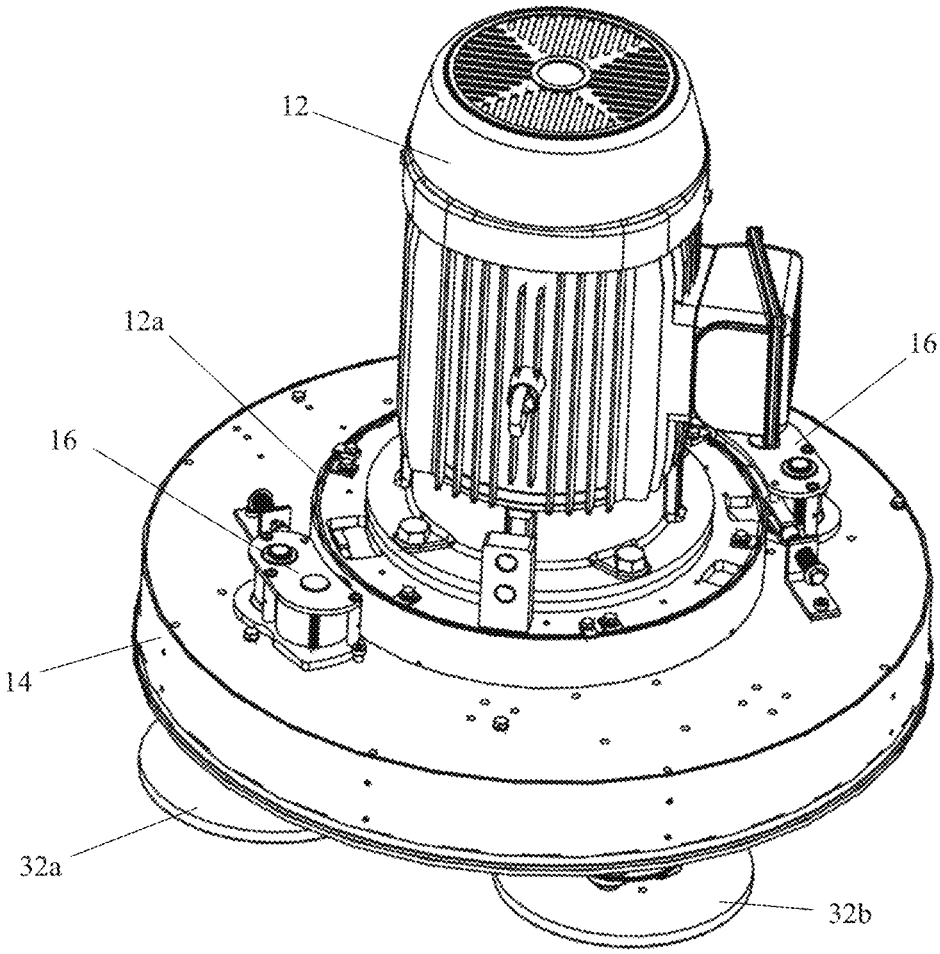
Figure 3:
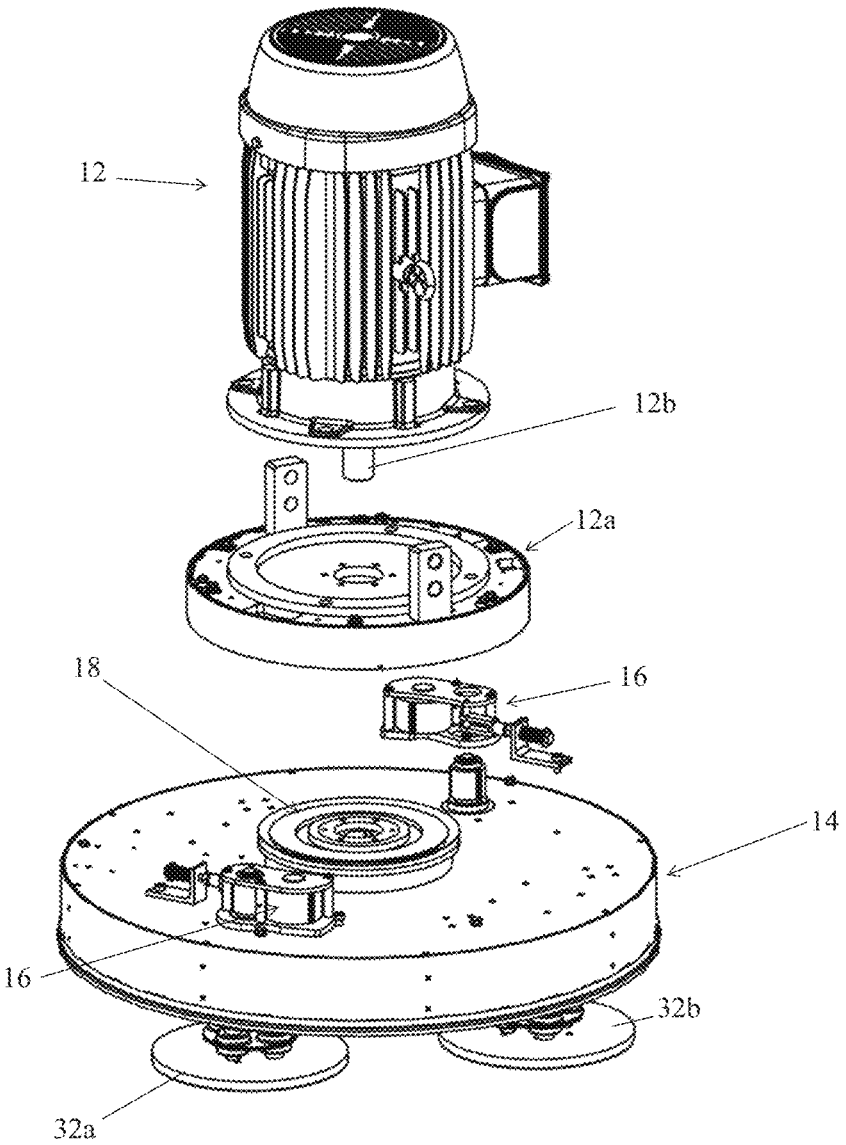
FIGS. 3 and 4 are partially exploded views of the grinder of FIGS. 1 and 2.
Figure 4:
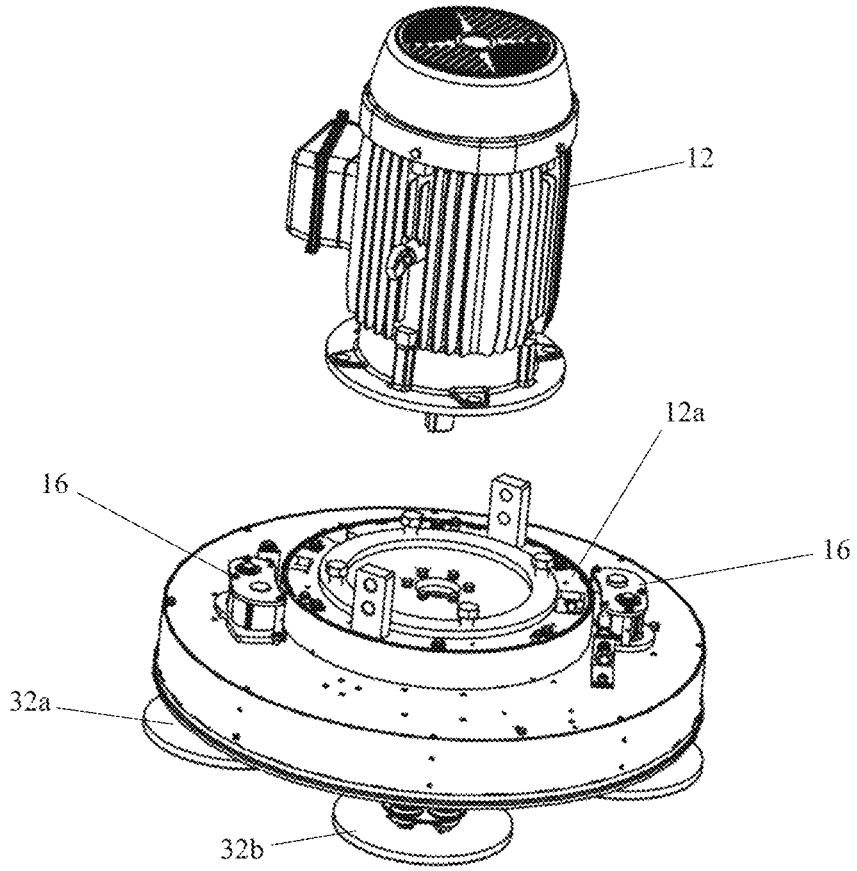

With reference to the drawings, the disclosure relates to a grinder 10 having a motor 12 mounted by a motor mount 12*a* onto a drum assembly 14, with one or more drive units 16 located on the exterior of the drum assembly 14 for rotation of the drum assembly 14. A bearing assembly 18 interfaces between the motor mount 12*a* and the drum assembly 14 to enable the drum assembly 14 to rotate relative to the motor 12. The grinder 10 may be integrated with a frame or the like having handles and controls for facilitating operation of the grinder 10.

The motor 12 is typically an electric motor. The motor 12 may have various motor power ratings, typically ranging between about 5 and 25 horsepower. The motor 12 is fixedly mounted to the motor mount 12*a*, and the motor mount 12*a* is rotatably mounted to the drum assembly 14 by the bearing 18. The motor 12 includes an output shaft 12*b* that is preferably driven at a variable rotary speed of from about 350 to about 1,400 revolutions per minute.

The drum assembly 14 includes a top plate 20 and circumferential sidewall 20*a*, a drive pulley 22, a drive belt 24, a plurality of idler pulleys 26*a*-26*c*, a plurality of driven pulleys 28*a*-28*d*, a bottom plate 30, and plurality of driven disks 32*a*-32*d*. A belt tensioner 34 is mounted to the underside of the top plate 20 to desirably adjust the tension of the drive belt 24.

The motor 12 is mounted to the exterior of the top plate 20 by the motor mount 12*a*. The output shaft 12*b* of the motor 12 extends into the drum assembly 14 via an aperture 36 centrally located on the top plate 20. The drive pulley 22 operatively engages the output shaft 12*b* of the motor 12 so as to rotate corresponding to the rotation of the output shaft 12*b*. The drive belt 24 travels around the idler pulleys 26*a*-26*c* and the driven pulleys 28*a*-28*d* and transfers rotation of the drive pulley to the driven pulleys 28*a*-28*d*. Together, the idler pulleys 26*a*-26*c* and the belt tensioner 34 serve to provide desired tension of the drive belt 24 and contact of the drive belt 24 with the driven pulleys 28*a*-28*d*. The drive belt 24 is the only traveling belt utilized on the grinder 10.

Figure 5:
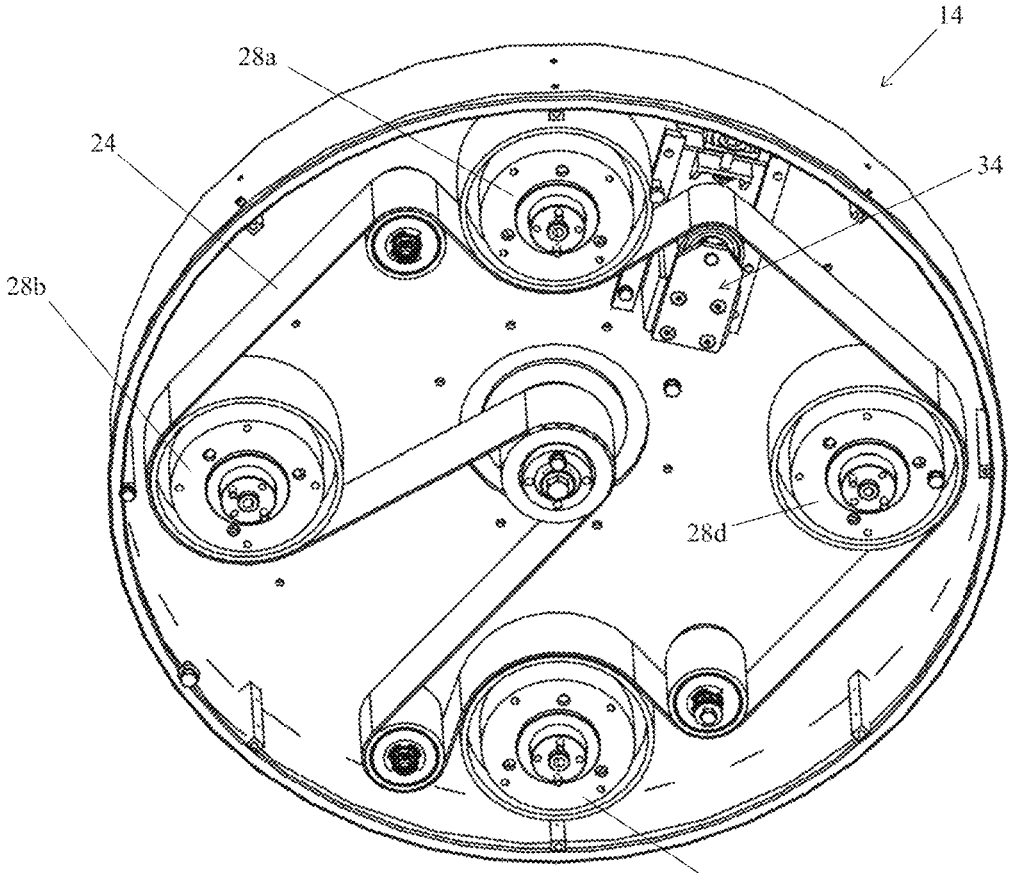
FIG. 5 is a lower perspective view of a drum assembly of the grinder of FIGS. 1 and 2.
Figure 6:
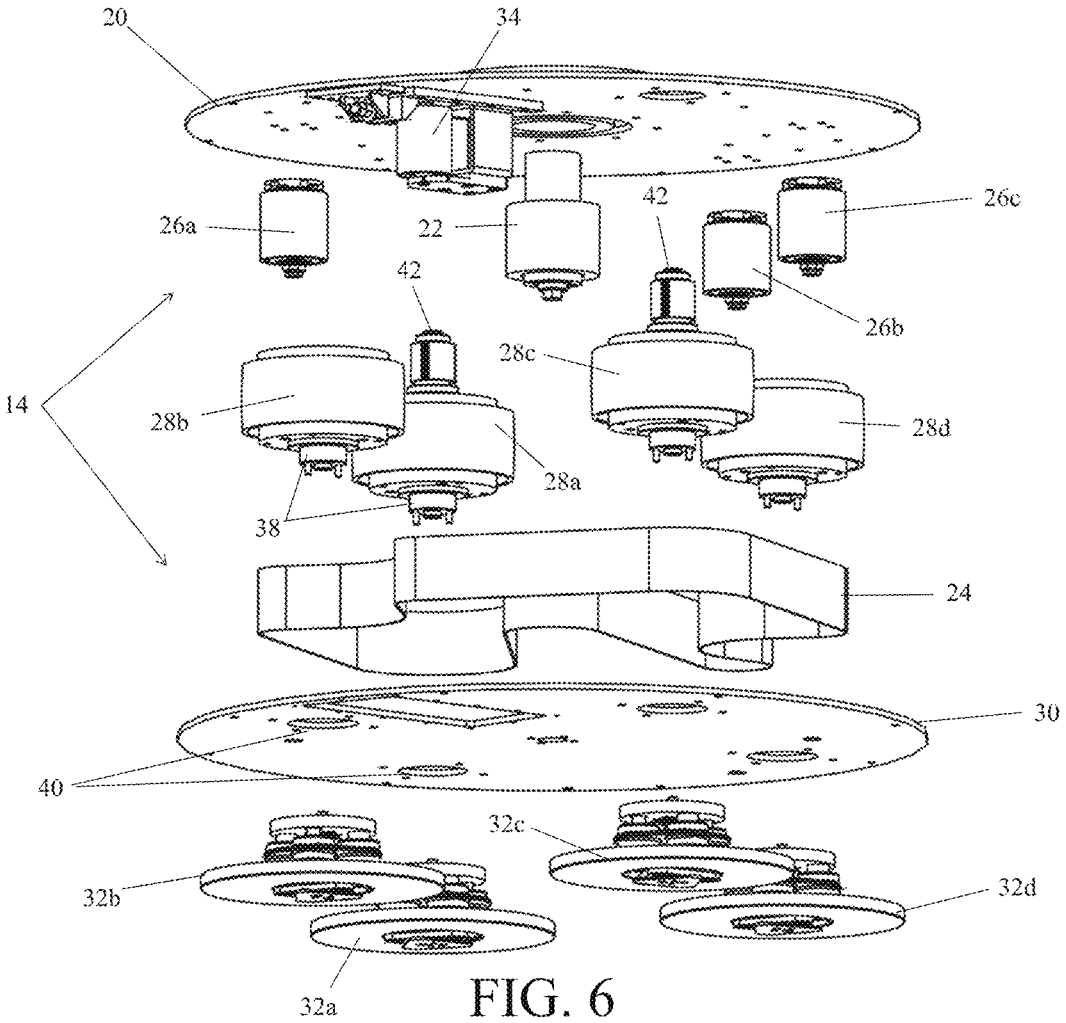
FIG. 6 is an exploded view of the drum assembly of FIG. 5.
Figure 7:
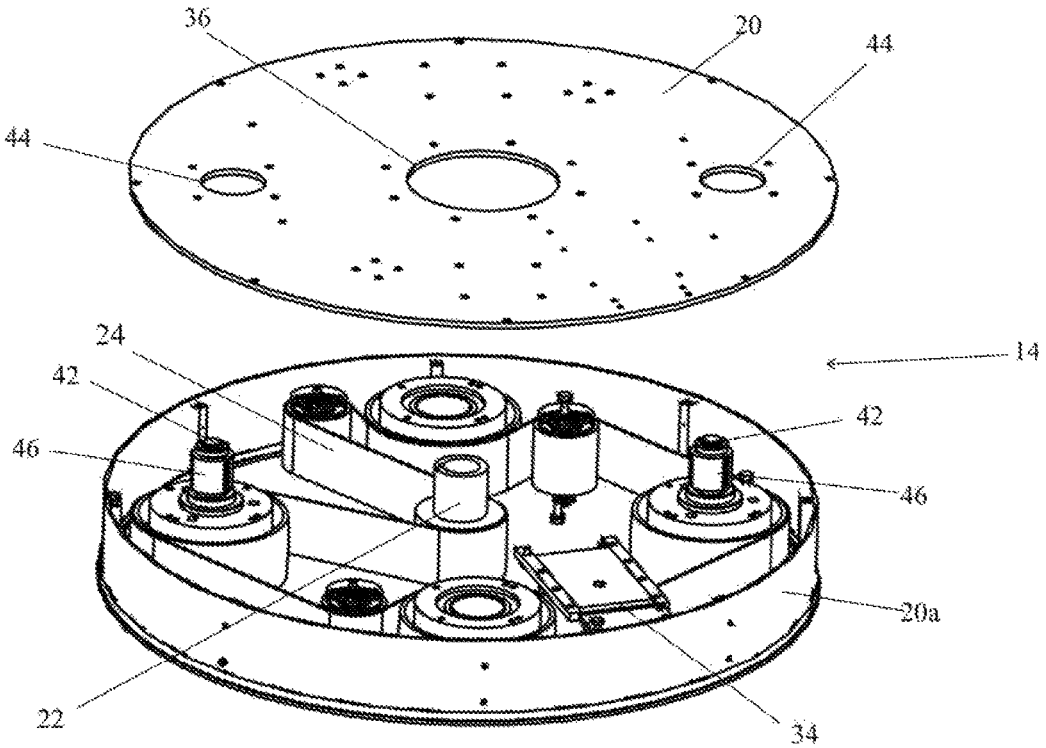
FIG. 7 is a partially exploded view of the drum assembly of FIG. 5.
Figure 8:
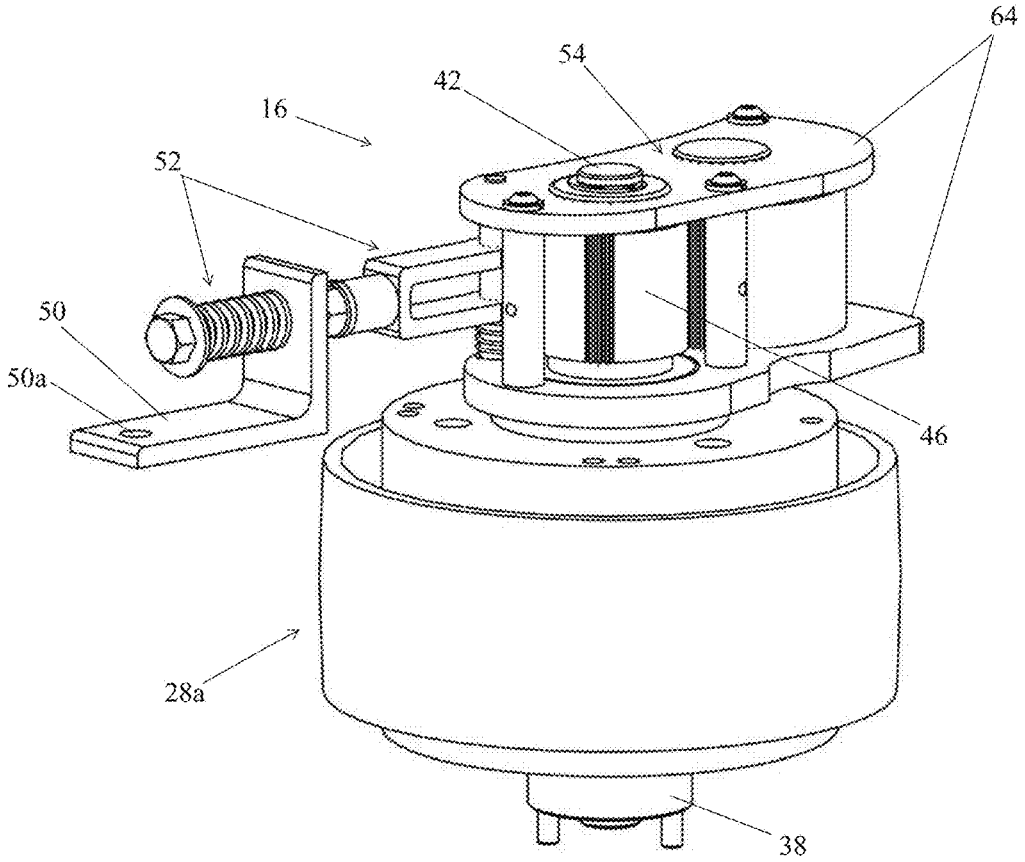
FIGS. 8 and 9 show a drum drive assembly of the grinder of FIGS. 1 and 2.
Figure 9:
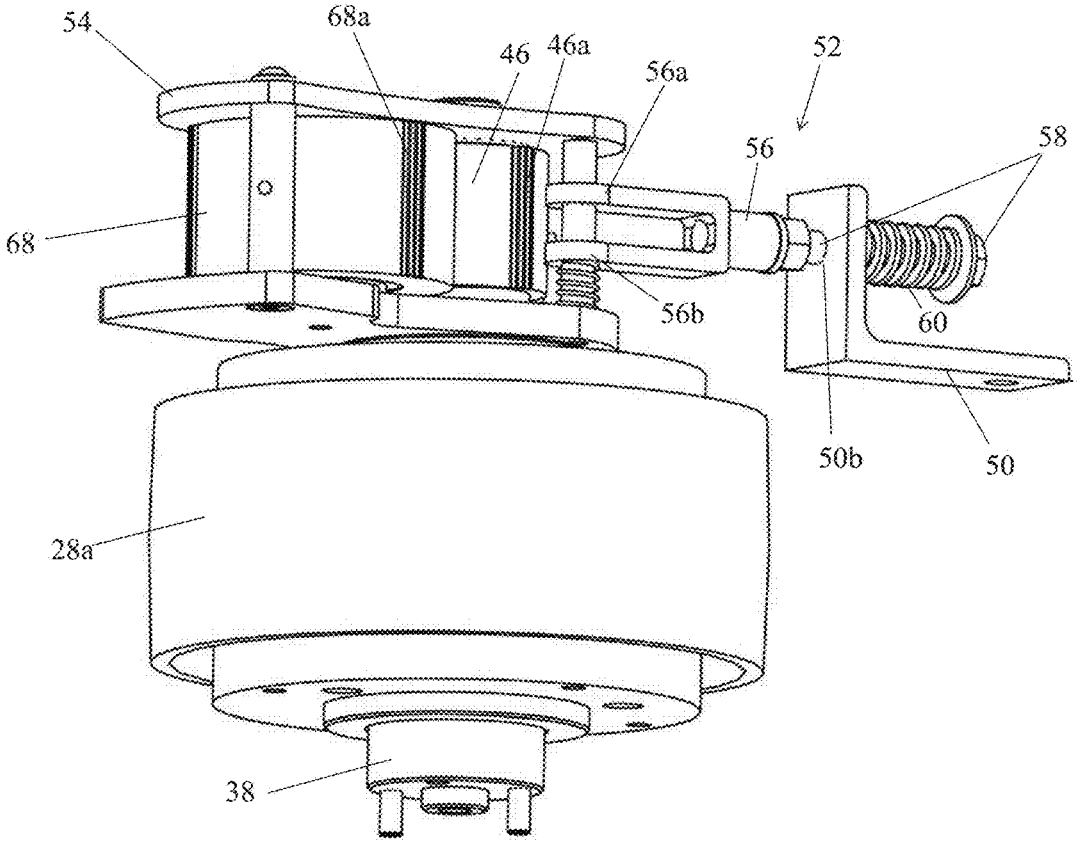
Figure 10:
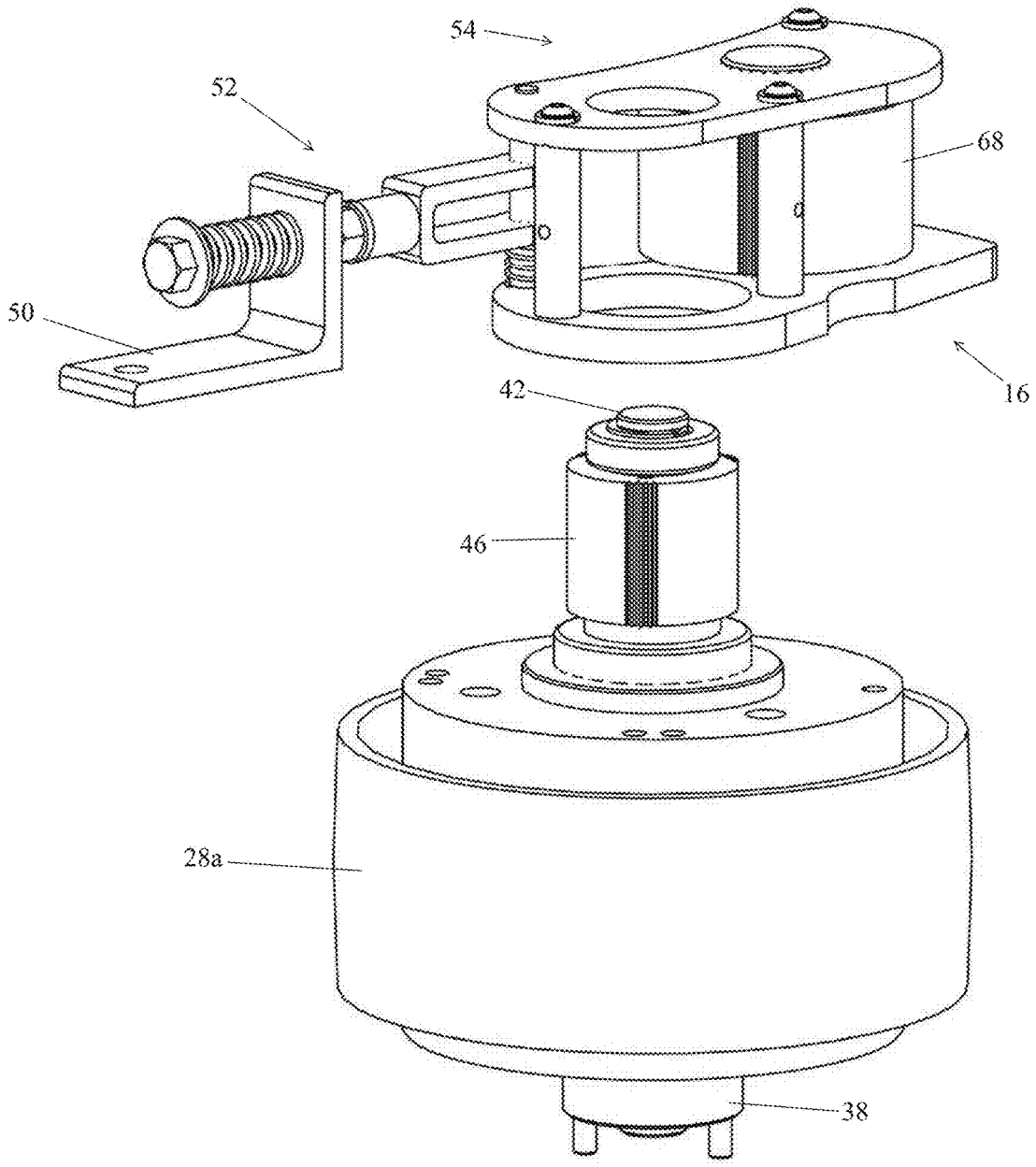
FIGS. 10 and 11 are partially exploded views of the drum drive assembly of FIGS. 8 and 9.
Figure 11:
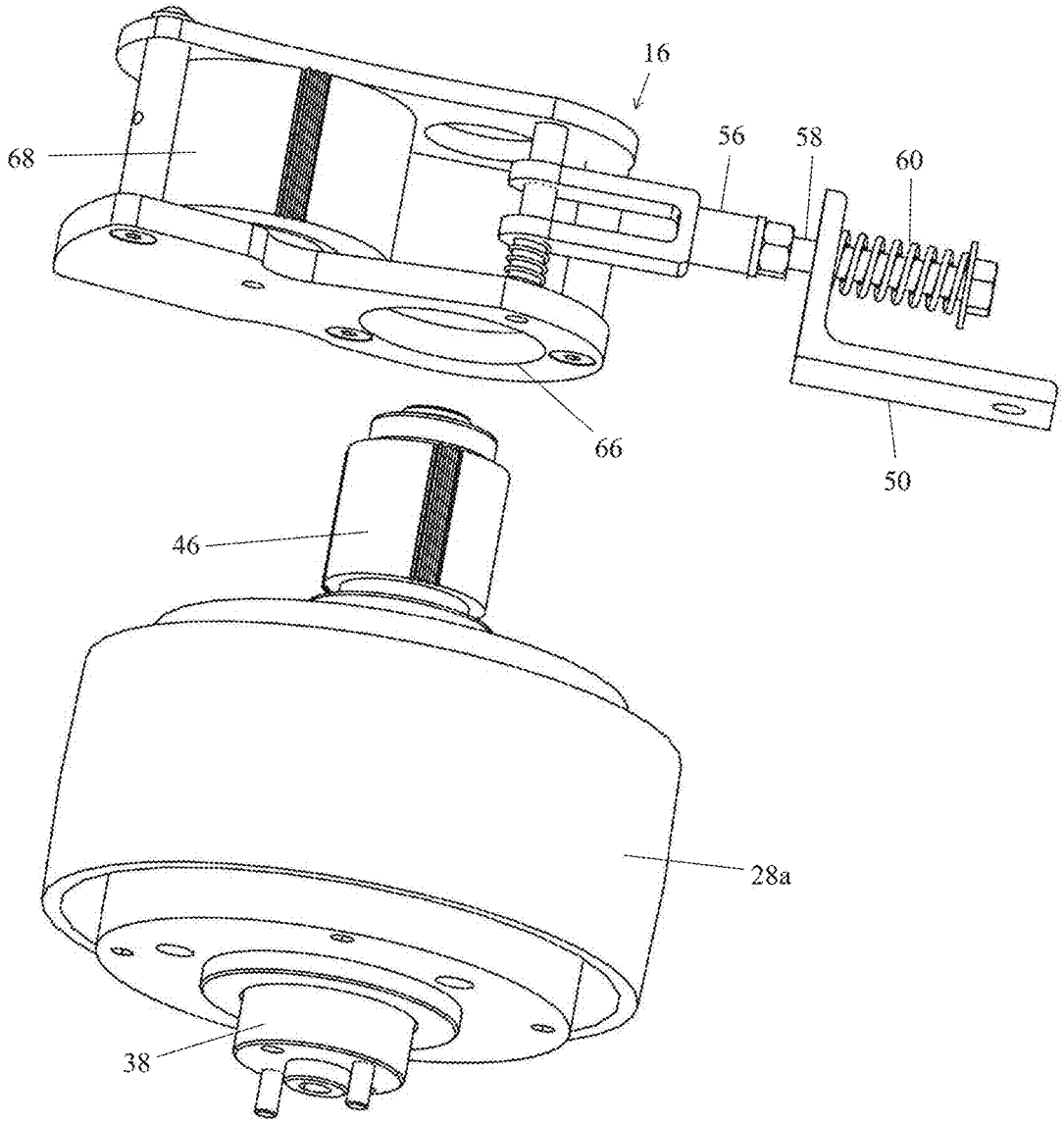

With reference to FIG. 5, it will be observed that the drive belt 24 is arranged to contact the driven pulleys 28*a* and 28*d* such that the driven pulleys 28*a* and 28*c* each rotate in the same direction and opposite to the direction of travel of the drive belt 24, and the driven pulleys 28*b* and 28*d* each rotate in the same direction and in the same direction of travel of the drive belt 24. Thus, if the drive belt 24 travels counter-clockwise, the driven pulleys 28*a* and 28*c* each rotate clockwise and the driven pulleys 28*b* and 28*d* each rotate counter-clockwise.

The driven pulleys 28*a*-28*d* each include a downwardly extending shaft 38 that extends from the bottom of each of the driven pulleys 28*a*-28*d* and passes through a corresponding aperture 40 of the bottom plate 30. The driven disks 32*a*-32*d* directly connect to the shafts 38 of the driven pulleys 28*a*-28*d* adjacent the exterior surface of the bottom plate 30, and rotate with the driven pulleys 28*a*-28*d*. Various work pieces, such as grinding disks and the like, may be connected to the driven disks 32*a*-32*d* for treating a flooring surface. Two of the driven pulleys, such as the driven pulleys 28*a* and 28*c* located opposite of one another, include upwardly extending shafts 42 that extend upwardly from the driven pulleys and extend through apertures 44 of the top plate.

With additional reference to FIGS. 8-11, the drive units 16 connect to and are driven by the upwardly extending shafts 42 of the driven pulleys 28*a* and 28*c*. In this regard, a gear pulley 46 is located on the shafts 46 to provide a rotary drive surface. Alternatively, the shaft 42 itself could provide the drive surface, or the shaft could be coated with rubber or the like to provide a drive surface. As described herein, the gear pulley 46 provides the drive surface. Each drive unit 16 includes an anchor plate 50 that mounts to the top plate 20 of the drum assembly 14. The anchor plate 50 is connected by a spring loaded yoke system 52 to a pulley mount 54. The drive units 16 are mounted onto the drum assembly 14 to drive the drum assembly in a direction opposite that of the rotation of the driven disks 32*a*-32*d*.

The anchor plate 50 may be an L-shaped metal plate having an aperture 50*a* in for mounting of the anchor plate 50 to the top plate 20 as by use of a fastener. An upstanding portion of the anchor plate includes an aperture 50*b* for mounting of the yoke system 52 to the anchor plate 50.

The yoke system 52 includes a yoke end 56 having a pair of arms 56*a* and 56*b* with aligned apertures for mounting of the yoke end 56 onto the pulley mount 54. To enable some controlled lateral relative movement, a threaded bolt 58 adjustably connects to the yoke end 56 and a compression spring 60 is located on the bolt 58 opposite the yoke end 56 to bear against the anchor plate 50. A compression spring 62 interfaces between the yoke end 56 and the pulley mount 54 for enabling controlled vertical movement of the pulley mount 54 relative to the yoke system 52.

The pulley mount 54 includes a frame 64 having an aperture 66 configured to receive the gear pulley 46 and configured to permit rotation of the gear pulley 46 as driven by the driven pulley 28*a* or 28*c*. The frame 64 is also configured to rotatably mount, preferably utilizing bearings or the like, a gear pulley 68 adjacent to and in frictional contact with the gear pulley 46 for being driven by the gear pulley 46. In this regard, the gear pulley 46 and the gear pulley 68 may include surfaces configured to encourage frictional interaction, such as including rubberized surfaces and/or cooperating ridges 46*a* and 68*a*, respectively. The ridges 46*a* and 68*a* are shown partly around the circumference, it being understood that they may preferably extend around the circumference. As will be understood, the gear pulley 46 rotating in a first direction, such as clockwise, will impart a rotation to the gear pulley 68 in a second, opposite direction, such as counter-clockwise.

The anchor plate 50, yoke system 52, and the pulley mount 54 cooperate to rotatably position the gear pulley 68 in contact with a circumferential surface 70 of the motor mount 12*a*. The circumferential surface 70 is preferably coated with a rubber or like material to frictionally engage the gear pulley, yet enable some slippage if substantial counter-rotational forces are encountered. Alternatively, a replaceable fixed (non-traveling) belt or band or sleeve or the like may be located around the circumferential surface 70 to contact the gear pulley 68.

In operation of the grinder 10, it will be understood that rotation of the output shaft 12*b* is transferred by the drive pulley 22 to cause the drive belt 24 to travel and transfer rotation to the driven pulleys 28*a*-28*d*, causing rotation of the driven disks 32*a*-32*d* in a first direction, such as clockwise. The clockwise rotation of the driven pulleys 28*a* and 28*c* provides clockwise rotation of the gear pulleys 46 mounted thereon, which transfers an opposite rotation of the gear pulleys 68. Thus, for example, clockwise rotation of the driven pulleys 28*a* and 28*c* provides clockwise rotation to the gear pulleys 46. The clockwise rotation of the gear pulleys 46 imparts opposite or counter-clockwise rotation to the gear pulleys 68. The gear pulleys 68 contact the circumferential surface 70 of the motor mount 12*b*, imparting an opposite, clockwise motion to the drum assembly 14.

Accordingly, in operation, rotation of the output shaft 12*b* of the motor 12 is transferred by the traveling drive belt 24. The drive belt 24 transfers its rotation to the driven pulleys 28*a*-28*d* to cause the driven pulleys 28*a* and 28*c* to rotate opposite of the direction of travel of the belt 24, and the cause the driven pulleys 28*b* and 28*d* to rotate in the same direction of travel as the drive belt 24. The rotation of the driven pulleys 28*a* and 28*c* rotates the gear pulleys 46 mounted thereto. The gear pulleys 46 contact the gear pulleys 68 of the drive units 16 to cause the gear pulleys 68 to rotate opposite of the driven pulleys 28*a* and 28*c*. The gear pulleys 68 contact the circumferential surface 70 of the motor mount 12*a* to cause the drum assembly 14 to rotate opposite the direction of rotation of the gear pulleys 68 and in the same direction as the driven pulleys 28*a* and 28*c*. The driven pulleys 28*b* and 28*d* rotate opposite of the drum assembly 14 and the driven pulleys 28*a* and 28*c*.

The foregoing description of preferred embodiments for this disclosure have been presented for purposes of illustration and description. They are not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A floor treatment device, comprising:

a motor having a rotatable output shaft;

a drum assembly comprising a drive pulley connected to the output shaft of the motor, at least two driven pulleys each operatively connected to a driven disk for treating a flooring surface, and a traveling belt travelable around the drive pulley and the two driven pulleys and configured to have a direction of travel imparted to it by the output shaft during operation of the motor to rotate the output shaft, the traveling belt arranged to impart travel to one of the driven pulleys in a direction corresponding to the direction of travel imparted to the traveling belt and to impart travel to the other one of the driven pulleys in a direction of travel opposite to the direction of travel imparted to the traveling belt, one of the driven pulleys having a shaft extending to an exterior portion of the drum assembly to provide a rotatable drive surface;

a motor mount connected to the motor;

a bearing between the motor mount and the drum assembly to enable the drum assembly to rotate relative to the motor;

a drum assembly drive surface operatively associated with the drum assembly; and a drive unit for imparting rotation to the drum assembly, the drive unit comprising a rotatable drive pulley positioned axially offset from and in contact with the rotatable drive surface of the driven pulley of the drum assembly and the drum assembly drive surface, the rotatable drive surface of the driven pulley being configured to impart rotation to the rotatable drive pulley of the drive unit during rotation of the rotatable drive surface, and the rotatable drive pulley of the drive unit being configured to impart rotation thereof to the drum assembly;

wherein, during operation of the motor, the output shaft rotates to travel the traveling belt and impart rotation to the two driven pulleys and the rotatable drive surface, whereby the rotatable drive surface imparts rotation to the rotatable drive pulley of the drive unit, which imparts rotation to the drum assembly.

2. A floor treatment device, comprising:

a motor having a rotatable output shaft;

a drum assembly comprising a drive pulley connected to the output shaft of the motor, a driven pulley operatively connected to a driven disk for treating a flooring surface, and a traveling belt travelable around the drive pulley and the driven pulley and configured to have a direction of travel imparted to it by the output shaft during operation of the motor to rotate the output shaft, the driven pulley having a shaft extending to an exterior portion of the drum assembly to provide a rotatable drive surface;

a motor mount connected to the motor;

a bearing between the motor mount and the drum assembly to enable the drum assembly to rotate relative to the motor;

a drum assembly drive surface operatively associated with the drum assembly; and a drive unit for imparting rotation to the drum assembly, the drive unit comprising a rotatable drive pulley positioned axially offset from and in contact with the rotatable drive surface of the driven pulley of the drum assembly and the drum assembly drive surface, the rotatable drive surface of the driven pulley being configured to impart rotation to the rotatable drive pulley of the drive unit during rotation of the rotatable drive surface, and the rotatable drive pulley of the drive unit being configured to impart rotation thereof to the drum assembly;

wherein, during operation of the motor, the output shaft rotates to travel the traveling belt and impart rotation to the two driven pulleys and the rotatable drive surface, whereby the rotatable drive surface imparts rotation to the rotatable drive pulley of the drive unit, which imparts rotation to the drum assembly.

3. A floor treatment device, comprising:

a drum assembly comprising a driven pulley having a rotatable drive surface;

a driven disk operatively connected to the driven pulley for treating a flooring surface;

a drum assembly drive surface operatively associated with the drum assembly; and a drive unit for imparting rotation to the drum assembly, the drive unit comprising a rotatable drive pulley positioned axially offset from and in contact with the rotatable drive surface of the driven pulley of the drum assembly and the drive surface of the drum assembly, the rotatable drive surface of the driven pulley being configured to impart rotation to the rotatable drive pulley of the drive unit during rotation of the rotatable drive surface, and the rotatable drive pulley of the drive unit being configured to impart rotation thereof to the drum assembly.

* * * * *